US007665920B2

(12) United States Patent
Hoffman et al.

(10) Patent No.: US 7,665,920 B2
(45) Date of Patent: Feb. 23, 2010

(54) CARD HOLDER FOR A CREDENTIAL PRODUCTION DEVICE

(75) Inventors: Ted M. Hoffman, Eden Prairie, MN (US); Jeffrey L. Stangler, Eagan, MN (US); John P. Skoglund, Minneapolis, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 523 days.

(21) Appl. No.: 11/683,795

(22) Filed: Mar. 8, 2007

(65) Prior Publication Data

US 2008/0217841 A1 Sep. 11, 2008

(51) Int. Cl.
*B41J 11/58* (2006.01)
*B41J 13/12* (2006.01)

(52) U.S. Cl. ..... 400/624; 271/147; 271/160; 271/165

(58) Field of Classification Search ..... 400/624; 271/165
See application file for complete search history.

(56) References Cited

U.S. PATENT DOCUMENTS 2,401,719 A * 6/1946 Braun ..... 271/165
3,731,781 A 5/1973 Caudill et al.
3,948,506 A * 4/1976 Crimmins et al. ..... 271/165
3,961,785 A * 6/1976 Gall ..... 271/165
4,299,504 A 11/1981 Benz et al.
4,305,577 A * 12/1981 Clay et al. ..... 271/165
4,527,149 A 7/1985 Swensen
4,590,486 A 5/1986 Yana
4,592,634 A * 6/1986 Koch ..... 271/165
4,607,832 A * 8/1986 Abe ..... 271/165
4,609,298 A 9/1986 Shioda
4,615,628 A 10/1986 Swinburne
4,990,008 A 2/1991 Hwang
5,004,218 A * 4/1991 Sardano et al. ..... 271/165
5,037,216 A 8/1991 Nubson et al.
5,064,301 A 11/1991 Nakamura et al.
5,301,834 A * 4/1994 Lee et al. ..... 271/165
5,519,429 A 5/1996 Zwijsen et al.
5,546,115 A 8/1996 Nardone et al.
5,547,298 A 8/1996 Wouters et al.

(Continued)

FOREIGN PATENT DOCUMENTS

JP 07040615 A 2/1995

(Continued)

OTHER PUBLICATIONS

Search Report and Written Opinion dated May 30, 2008 for International Application No. PCT/US2008/000853.

(Continued)

*Primary Examiner*—Jill E Culler
(74) *Attorney, Agent, or Firm*—Leanne Taveggia Farrell; Westman, Champlin & Kelly P.A.

(57) ABSTRACT

A credential production device is provided. The credential production device includes a card holder. The card holder includes a housing having a base and a card press. The card press is configured to apply a load to a top card of a stack of cards supported above the base. The load includes a perpendicular load component oriented perpendicularly to the base and having a magnitude that increases as a thickness of the stack of cards decreases.

20 Claims, 10 Drawing Sheets

U.S. PATENT DOCUMENTS

| | | | | |
|---|---|---|---|---|
| 5,558,449 | A | | 9/1996 | Morgavi |
| 5,597,248 | A | | 1/1997 | Burgin |
| 5,739,835 | A | | 4/1998 | Morgavi et al. |
| 5,769,548 | A | | 6/1998 | Thompson et al. |
| 5,829,631 | A | * | 11/1998 | Kasper ..... 271/160 |
| 5,895,157 | A | | 4/1999 | Morimura et al. |
| 5,936,646 | A | | 8/1999 | Kenny et al. |
| 5,941,522 | A | | 8/1999 | Hagstrom et al. |
| 6,261,012 | B1 | | 7/2001 | Haas et al. |
| 6,486,904 | B1 | | 11/2002 | Onozato et al. |
| 6,616,360 | B2 | | 9/2003 | Lehmkuhl |
| 6,626,594 | B1 | | 9/2003 | Lallemant |
| 6,714,228 | B1 | | 3/2004 | Holland et al. |
| 6,827,509 | B2 | | 12/2004 | Suden et al. |
| 6,910,656 | B2 | | 6/2005 | Lysiak et al. |
| 7,018,117 | B2 | | 3/2006 | Meier et al. |
| 7,549,633 | B2 | * | 6/2009 | Nishitani et al. ..... 271/165 |
| 2001/0046401 | A1 | | 11/2001 | Lien et al. |
| 2004/0109715 | A1 | | 6/2004 | Meier et al. |
| 2005/0078998 | A1 | | 4/2005 | Lien et al. |

FOREIGN PATENT DOCUMENTS

| | | | |
|---|---|---|---|
| JP | 07256755 | A | 10/1995 |
| JP | 10016186 | A | 1/1998 |

OTHER PUBLICATIONS

Search Report and Written Opinion dated Jun. 26, 2008 for International Application No. PCT/US2008/001031.
Search Report and Written Opinion dated Jun. 26, 2008 for International Application No. PCT/US2008/002207.
Search Report and Written Opinion dated Jun. 4, 2008 for International Application No. PCT/US2008/000851.

* cited by examiner

CARD HOLDER FOR A CREDENTIAL PRODUCTION DEVICE

CROSS-REFERENCE TO RELATED APPLICATIONS

This application incorporates herein by reference in their entirety the following applications filed on Mar. 8, 2007: U.S. patent application Ser. No. 11/683,771 entitled "SUBSTRATE FEEDING IN A CREDENTIAL PRODUCTION DEVICE" having inventors Ted M. Hoffman, Jeffrey L. Stangler, John P. Skoglund and Tony Nauth and; U.S. patent application Ser. No. 11/683,816 entitled "CREDENTIAL PRODUCTION PRINT RIBBON AND TRANSFER RIBBON CARTRIDGES" having inventor Ted M. Hoffman and; U.S. patent Application Ser. No. 11/683,827 entitled "PRINTHEAD ASSEMBLY FOR A CREDENTIAL PRODUCTION DEVICE" having inventor Ted M. Hoffman and; U.S. patent application Ser. No. 11/683,835 entitled "CANTILEVERED CREDENTIAL PROCESSING DEVICE COMPONENT" having inventors Ted M. Hoffman and Thomas G. Gale Jr. and; U.S. patent application Ser. No. 11/683,710 entitled "CREDENTIAL PRODUCTION DEVICE HAVING A UNITARY FRAME" having inventors Ted M. Hoffman and James R. Cedar and; U.S. patent application Ser. No. 11/683,850 entitled "INVERTED REVERSE-IMAGE TRANSFER PRINTING" having inventors Ted M. Hoffman, Jeffrey L. Stangler, John P. Skoglund, Thomas G. Gale Jr. and Tony Nauth.

FIELD OF THE INVENTION

The present invention is generally directed to a credential production device. More particularly, the present invention is directed to feeding substrates in a credential production device.

BACKGROUND OF THE INVENTION

Credentials include, for example, identification cards, driver's licenses, passports, and other valuable documents. Such credentials are formed from credential substrates including paper substrates, plastic substrates, cards and other materials. Such credentials generally include printed information, such as a photo, account numbers, identification numbers, and other personal information that is printed on the credential substrates using a print consumable, such as ink and ribbon.

Credential production devices process credential substrates by performing at least one step in forming a final credential product. One type of credential production device is a reverse-image credential printing device. Reverse-image credential production devices generally include a printing section and an image transfer section. The printing section utilizes an intermediate transfer film or transfer ribbon, a print ribbon and a printhead. The printhead is typically a thermal printhead that operates to heat different colored dye panels of a thermal print ribbon to transfer the colored dye from the print ribbon to a panel of transfer film to form the image thereon. After the printed image on the transfer film is registered with a substrate, a heated transfer roller of the image transfer section transfers the image from the transfer film or transfer ribbon to a surface of the substrate.

Conventional reverse-image credential printing devices are typically large, cumbersome and complicated machines where improvements to these types of machines are in continuous demand. For example, there is a continuous demand for improving the process by which credential substrates are fed from a substrate holder at a substrate input along a substrate feed path to a substrate output or substrate hopper such that a substrate is not misfed in a credential production device.

Embodiments of the present invention provide solutions to these and other problems, and offer other advantages over the prior art.

SUMMARY OF THE INVENTION

A credential production device is provided. The credential production device includes a card holder. The card holder includes a housing having a base and a card press. The card holder is configured to support a stack of cards above the base. A top card of the stack of cards is displaced a greater distance from the base than a bottom card of the stack of cards. The card press is configured to apply a load to a top card of a stack of cards supported above the base. The load includes a perpendicular load component oriented perpendicularly to the base and having a magnitude that increases as a thickness of the stack of cards decreases. The credential production device also includes a card transport that is configured to feed the bottom card from the stack of cards along a card feed path and a card processing device in line with the card feed path. The card processing device is configured to perform a process on the card.

DETAILED DESCRIPTION OF ILLUSTRATIVE EMBODIMENTS

Figure 1:
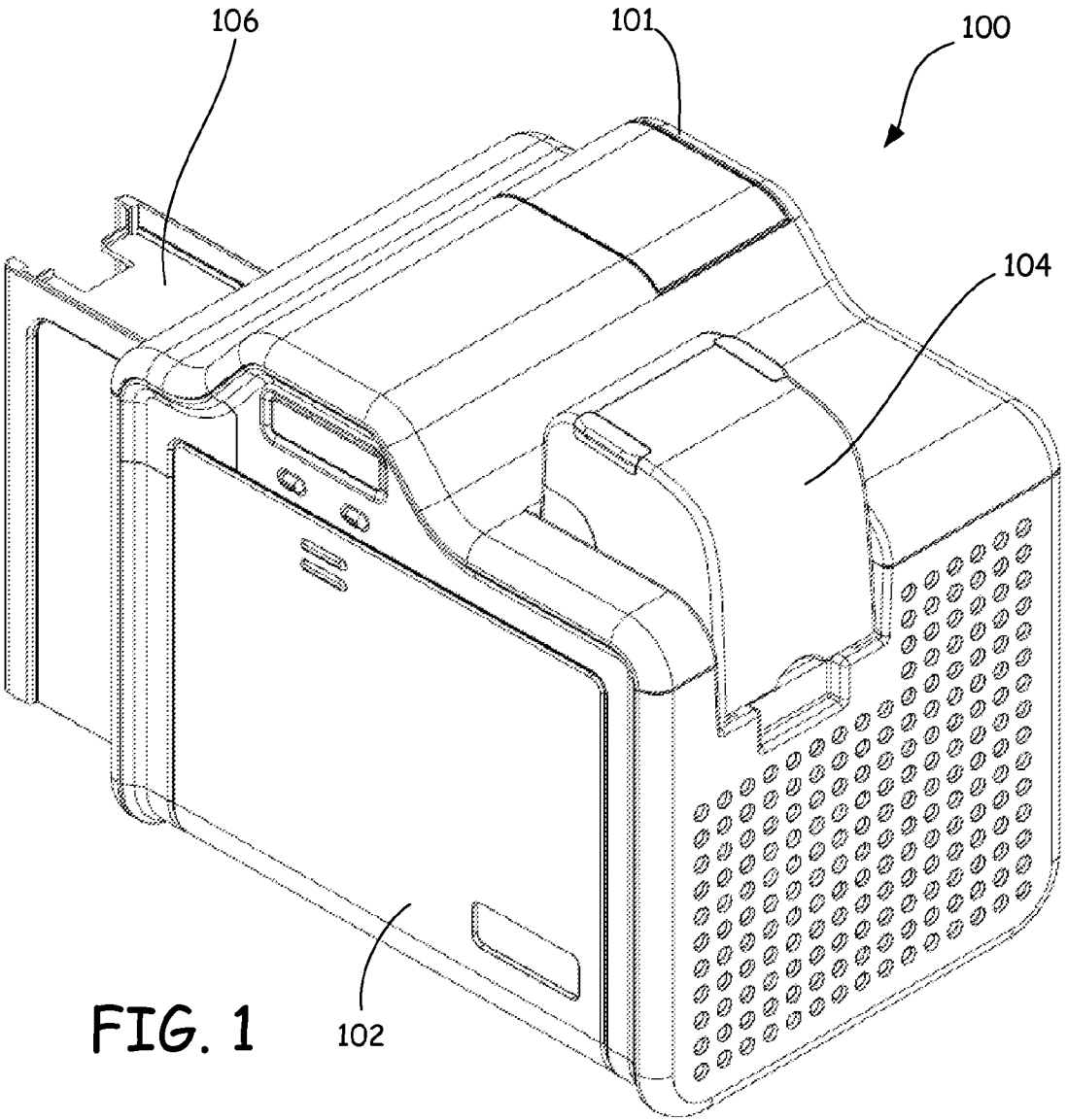
FIG. 1 is an exemplary perspective view of a credential production device under embodiments of the invention.
Figure 2:
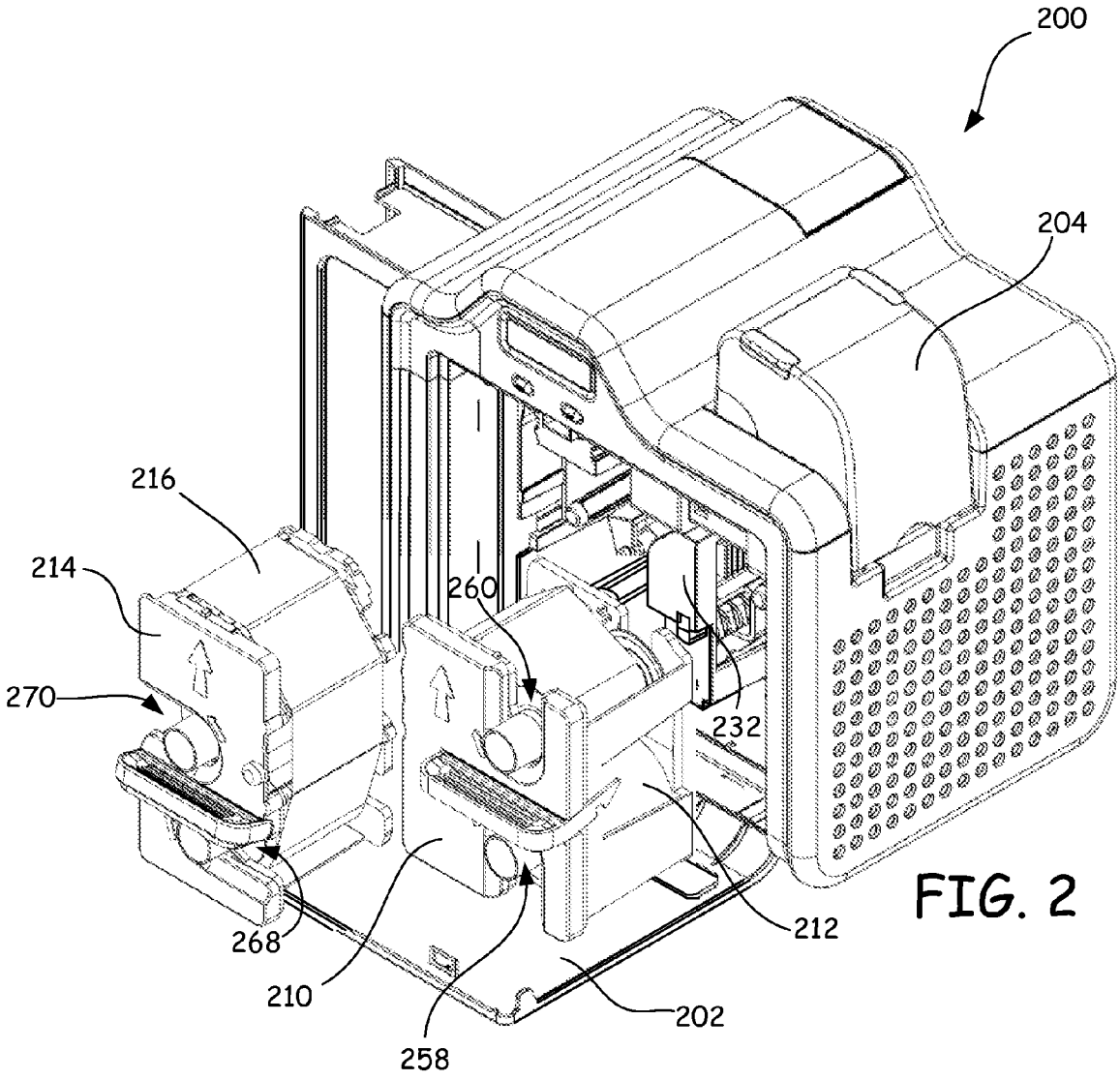
FIG. 2 is an exemplary exploded perspective view of the credential production device of FIG. 1 under embodiments of the invention.

FIGS. 1 and 2 illustrate exemplary perspective views of credential production devices in accordance with embodiments of the invention. FIG. 1 illustrates an exterior view of a credential production device 100. Exemplary credential production device 100 includes an enclosure 101 having a front panel 102. Credential production device 100 utilizes a substrate holder 104, a substrate transport mechanism to transport credential substrates along a substrate feed path to be discharged into a substrate hopper 106. Some embodiments of the disclosure pertain to credential production device 100 as being a reverse-image printer and, therefore, embodiments of the disclosure pertain to the use of credential production device 100 for printing credential substrates to form credentials. However, it should be understood that credential production device 100 can be other types of devices, such as a laminating device, an encoding device or a card flipping device. Device 100 will be described as utilizing credential substrates. In some embodiments, credential substrates are in the form of card substrates for the creation of identification cards. In other embodiments, other types of substrates can be used for forming credentials, such as overlaminate substrates, passport substrates and other valuable substrates.

Figure 3:
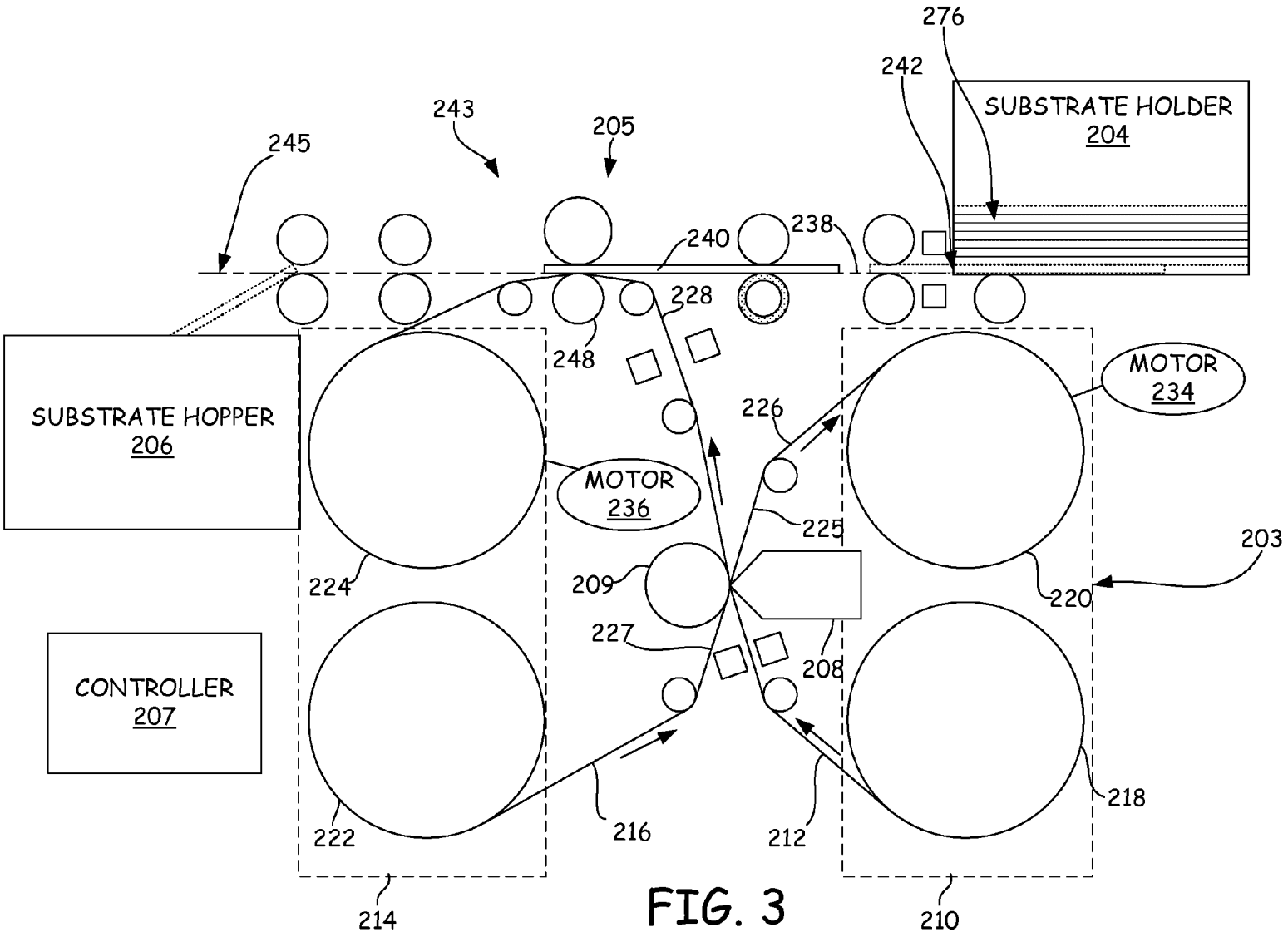
FIG. 3 is an exemplary simplified schematic diagram of the credential production device illustrated in FIGS. 1 and 2.

FIG. 2 illustrates an exemplary exploded view of a credential production device 200. Credential production device 200 is an exemplary inverted reverse-image transfer printer as previously discussed as an embodiment of the invention. FIG. 3 illustrates a simplified schematic diagram of exemplary device 200. Credential production device 200 provides inverted reverse-image transfer printing using printing components that are inverted relative to a position of printing components in a conventional reverse-image printing device with respect to a substrate feed path 238 (FIG. 3). Unlike conventional production devices, the inverted nature of credential production device 200 locates production components below its substrate feed path 238. Such a configuration aids in making credential production device 200 more compact, especially in height, allows heat from a transfer roller to dissipate more efficiently and simplifies a substrate feed path of which a credential substrate is transported. Therefore, some embodiments of the disclosure pertain to the use of a substrate holder 204 that contain substrates in credential production device 200. However, it should be understood that embodiments of substrate holder 204 and embodiments of a method of feeding substrates as will be discussed can also be used in other types of credential production devices, such as non-reverse-image credential printing devices, credential laminating devices and credential encoding devices. Before discussing embodiments of the disclosure in detail, components of the embodiment of credential production device 200 providing inverted reverse-image transfer printing will be briefly described.

In FIG. 2, front panel 202 is removed to more clearly illustrate main production components internal to credential production device 200. Credential production device 200 includes a removable print ribbon cartridge 210 and a removable transfer film cartridge 214, both of which are below substrate feed path 238 (FIG. 3). Print ribbon cartridge 210 and transfer ribbon cartridge 214 are releasable and removable from an internal frame 230 of credential production device 200 that is configured to house print ribbon cartridge 210 and transfer ribbon cartridge 214. In FIG. 2, print ribbon cartridge 210 includes a supply spool receiver 258 positioned below a take-up spool receiver 260 and transfer ribbon cartridge 214 includes a supply spool receiver 268 positioned below a take-up spool receiver 270. Supply spool receiver 258 and take-up spool receiver 260 of print ribbon cartridge 210 are configured to receive both ends of a print ribbon 212. Supply spool receiver 268 and take-up spool receiver 270 of transfer ribbon cartridge 214 are configured to receive both ends of a transfer ribbon 216. In other embodiments, the take-up spool receivers in either print ribbon cartridge 210 or transfer ribbon cartridge 214 can be positioned below the supply spool receivers.

When print ribbon cartridge 210 is inserted into credential production device 200, embodiments of print ribbon cartridge 210 also receive a printhead housing 232 contained in internal frame 230. Printhead housing 232 houses a printhead 208 (FIG. 3). In addition, when transfer ribbon cartridge 214 is inserted into credential production device 200, embodiments of transfer ribbon cartridge 214 also receive a transfer roller assembly 247 that includes a transfer roller 248 (FIG. 3).

As illustrated in FIG. 3, credential production device 200 includes a printing section 203 and an image transfer section 205. A controller 207 controls the components of credential production device 200 to perform various operations including substrate feeding, printing an image to a transfer film or ribbon, transferring the image to a substrate, sensor calibration and other operations.

In one embodiment, printing section 203 includes printhead 208, a print platen 209, print ribbon cartridge 210 for supporting a print ribbon 212 and transfer ribbon cartridge 214 for supporting transfer ribbon 216. Print ribbon 212 (e.g., dye sublimation print ribbon) is wound about a supply spool 218 and a take-up spool 220. Supply spool 218 is received by supply spool receiver 258 (FIG. 2) and take-up spool 220 is received by take-up spool receiver 260 (FIG. 2). Transfer ribbon 216 is wound about a supply spool 222 and a take-up spool 224. Supply spool 222 is received by supply spool receiver 268 (FIG. 2) and take-up spool 224 is received by take-up spool receiver 270 (FIG. 2). Print ribbon 212 includes a first surface 225 and a second surface 226 opposite the first surface. When print ribbon 212 is wound about spools 218 and 220, first surface 225 faces the interior of print ribbon cartridge 210 and second surface 226 faces transfer ribbon cartridge 214. Transfer ribbon 216 includes a first surface 227 and a second surface 228 opposite the first surface. When transfer ribbon 216 is wound about spools 222 and 224, first surface 227 faces the interior of transfer ribbon cartridge 214 and second surface 228 faces print ribbon cartridge 210.

Print ribbon 212 and transfer ribbon 216 are fed between printhead 208 and platen 209. Printhead 208 is positioned within printhead housing 232 (FIG. 2) and allowed to rotate about a rotation path such that heating elements face and apply pressure on print platen 209 and therefore places second surface 226 of print ribbon 212 in contact with second surface 228 of transfer ribbon 216. Print ribbon 212 extends between second surface 228 of transfer ribbon 216 and printhead 208.

Credential production device 200 includes motors 234 and 236 for operating the movement of print ribbon 212 and transfer ribbon 216, respectively. Printhead 208 applies pressure against print platen 209 such that printhead 208 is in contact with first side 225 of print ribbon 212 and brings print ribbon 212 in contact with second side 228 of transfer ribbon 216. In one embodiment, printhead 208 is a thermal printhead having a plurality of burn or heating elements. The burn elements on printhead 208 transfer a reverse-image onto a panel of transfer ribbon 216 using print ribbon 212. Printhead 208 prints each panel of transfer ribbon 216 while oriented approximately perpendicularly to substrate feed path 238 and positioned below substrate feed path 238. The reverse-image on the panel of transfer ribbon 216 is then moved towards feed path 238 for transferring the reverse-image to a credential substrate 240.

In another exemplary embodiment, image transfer section 205 includes a substrate input 242, a substrate transport 243, and a substrate output 245. Credential substrate 240 is received by substrate transport 243 from substrate holder 204 that includes a stack of credential substrates 276 at substrate input 242. Controller 207 controls substrate transport 243 to feed individual credential substrates 240 along substrate feed path 238 from a bottom of the stack of credential substrates. In one embodiment, processing path 238 is substantially flat between substrate input 242 and substrate output 245 to avoid any bending or damaging of substrates 240, particularly when they are in the form of rigid or semi-rigid plastic card substrates used to form identification cards. At substrate output 245, credential substrate 240 is discharged into substrate hopper 206. Along with components located below substrate feed path 238 for transferring an image to credential substrate 240, substrate hopper 206 and substrate output 245 are also positioned below substrate feed path 238. Credential substrate 240, when discharged through substrate output 245 falls into substrate hopper 206. Unlike conventional reverse-image production devices, such configurations aid in making credential production device 200 more compact, especially in height, allows heat from transfer roller 248 to dissipate more efficiently and simplifies substrate feed path 238 of which credential substrate 240 is transported.

Figure 4:
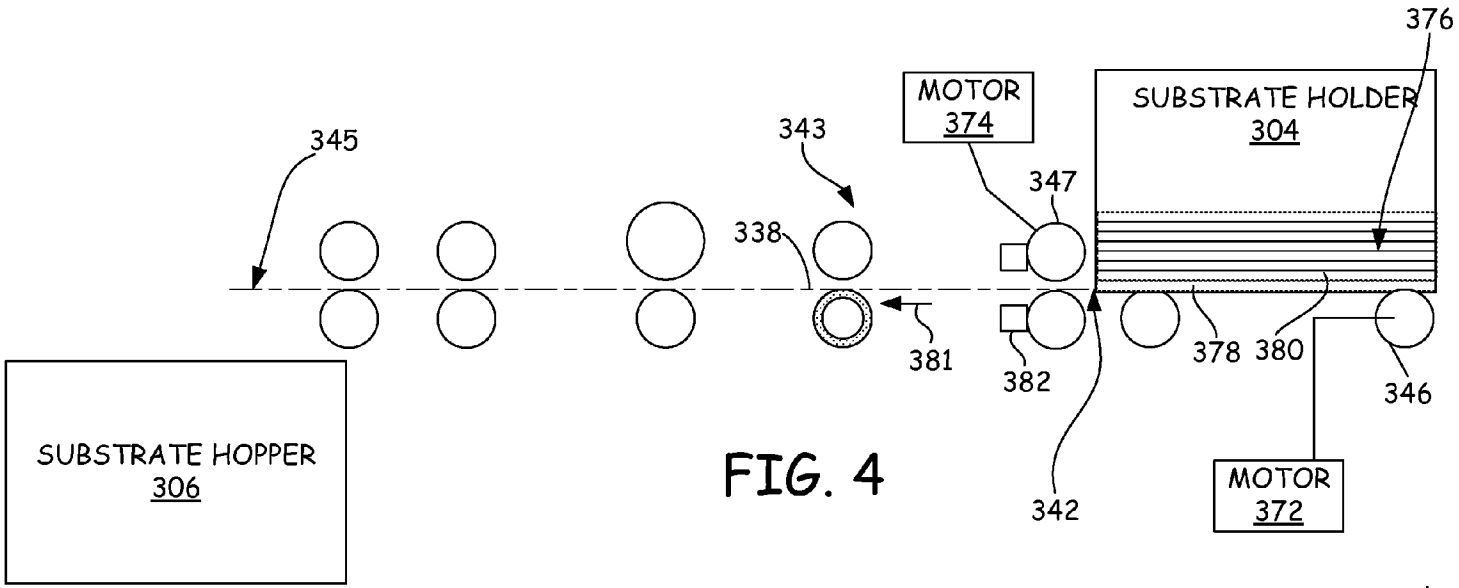
FIGS. 4-6 are simplified schematic diagrams of a substrate transport under embodiments of the invention.
Figure 5:
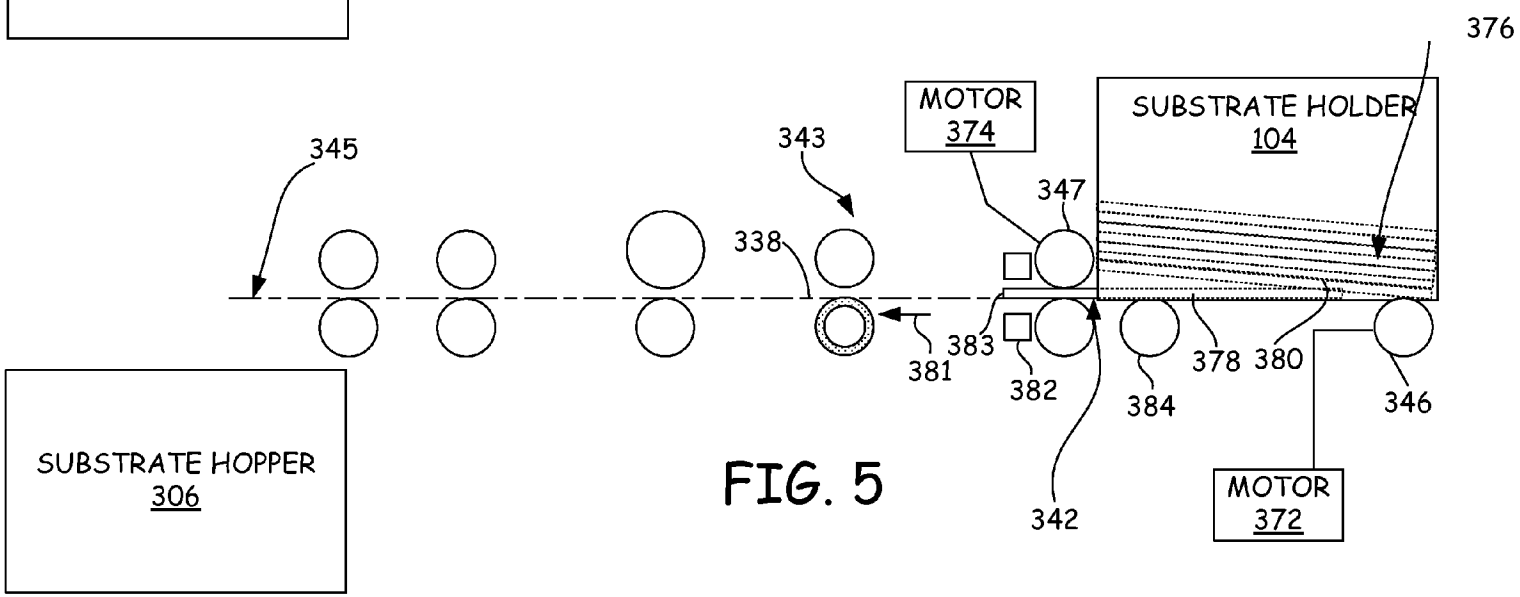
Figure 6:
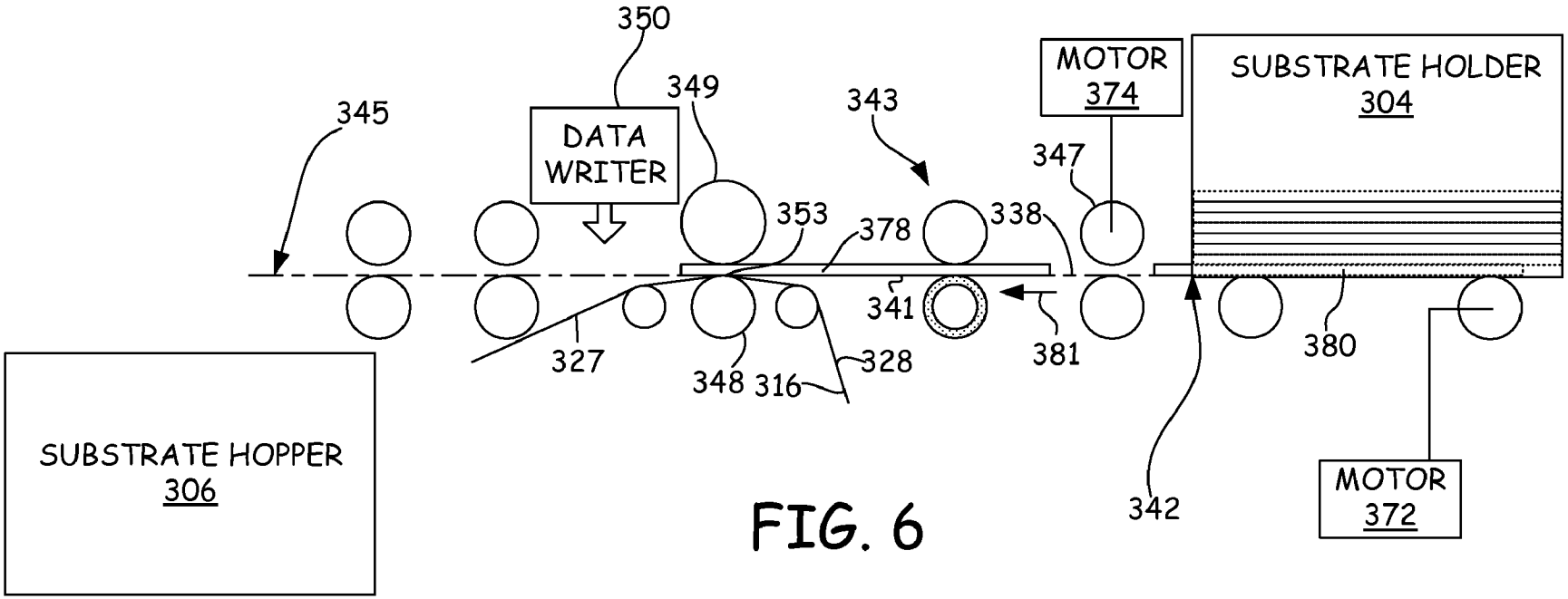
Figure 7:
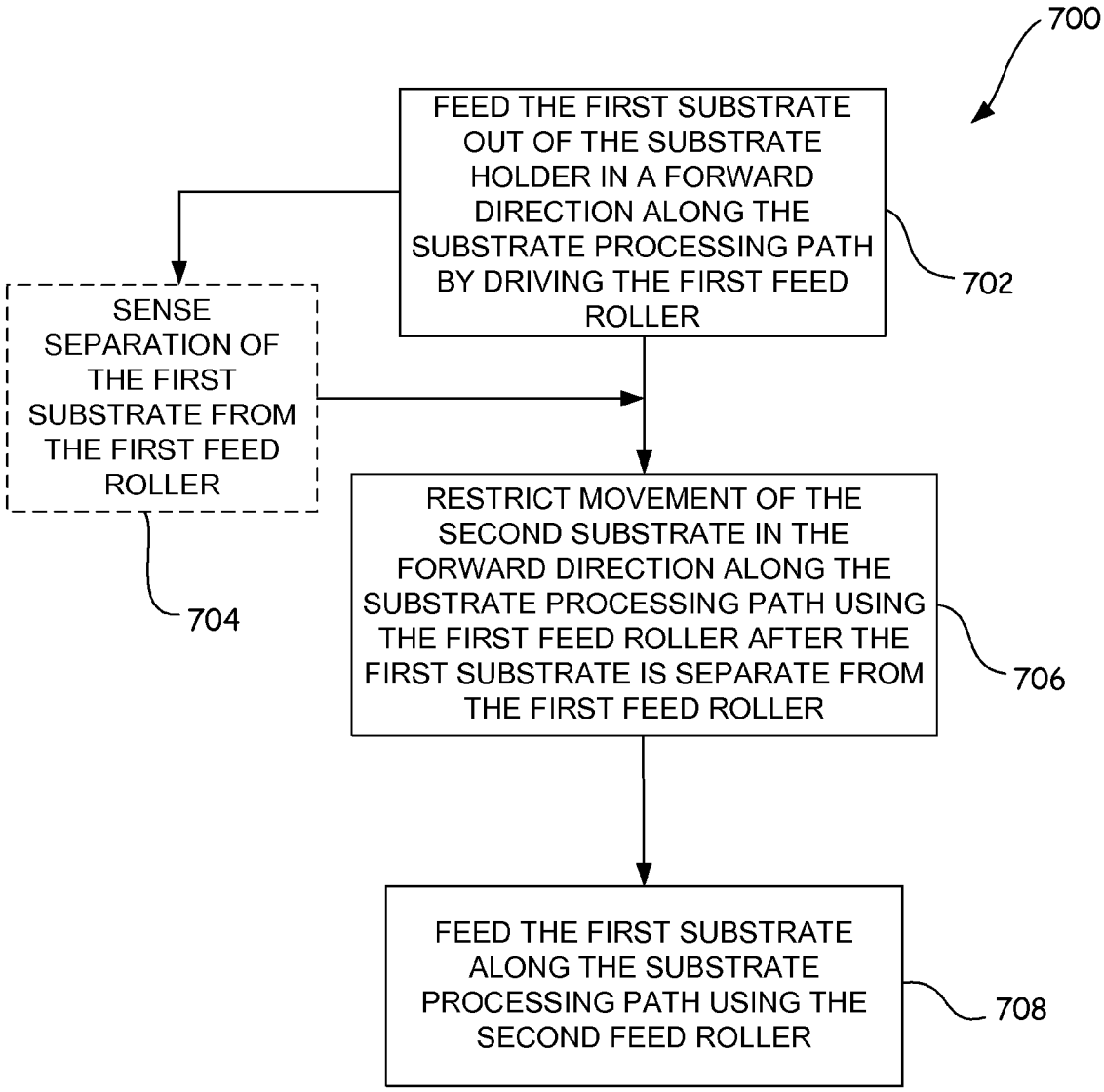
FIG. 7 is a flowchart illustrating a method of feeding substrates in a credential production device under embodiments of the invention.

FIGS. 4, 5 and 6 are detailed diagrammatic illustrations of the transport of substrates using substrate transport 343 in a credential production device. FIG. 7 is a flowchart illustrating a method of feeding credential substrates in a credential production device, such as credential production devices 100 and 200. The following description utilizes FIGS. 4-7 to describe the method of feeding credential substrates in a credential production device.

In FIGS. 4, 5 and 6, substrate transport 343 includes a first substrate feed roller 346 and a second substrate feed roller 347 displaced along a substrate feed path 338. First substrate feed roller 346 is located below substrate holder 304. Second substrate feed roller 347 is located proximate to substrate input 342 and between a substrate hopper 306 and a substrate holder 304 along substrate feed path 338. Substrate rollers 346 and 347 are driven by motors through gear and pulley arrangements or other configurations. In the embodiments illustrated in FIGS. 4, 5 and 6, separate motors are used for each feed roller 346 and 347. For example, a first motor 372 can be used to drive first feed roller 346 and a second motor 374 can be used to drive second substrate roller 347. As previously mentioned, substrate holder 304 includes a stack of credential substrates 376. At any given moment and as clearly shown in FIG. 4, stack of substrates 376 positioned in substrate holder 304 includes a bottom credential substrate or first credential substrate 378 and includes a second credential substrate 380 that lies on top of first credential substrate 378.

To feed substrates from stack of substrates 376, first substrate 378 is fed out of substrate holder 304 in a forward direction 381 along substrate feed path 338 using first feed roller 346 driven by first motor 372. Such a step is illustrated in block 702 of FIG. 7. As illustrated in FIG. 4, first feed roller 346 engages first credential substrate 378 to feed first substrate 378 out of substrate holder 304. Substrate holder 304 includes a flexible gate (not shown in FIGS. 4-6). First feed roller 346 feeds first substrate 378 out of substrate holder 304 and through the flexible gate.

In FIG. 7, the method of feeding substrates in a credential production device optionally includes the step of sensing the separation of first substrate 378 from first feed roller 346 as illustrated in dashed block 704. In one embodiment, a sensor 382 senses the presence of first substrate 378 at a certain location along feed path 338 that indicates that first substrate 378 has separated from first feed roller 346. For example, sensor 382 can sense the presence of a leading edge end 383 of first substrate 378 that is outside substrate holder 304 at a given distance. Such a sensed positioned is illustrated in FIG. 5.

At block 706, first feed roller 346 restricts movement of second substrate 380 in forward direction 381 along substrate feed path 338 after first feed roller 346 is disengaged from first substrate 378. As diagrammatically illustrated in FIG. 5, the step in block 706 of FIG. 7 can be accomplished by deactivating first motor 372. The step illustrated in block 704 can also be accomplished by deactivating first motor 372 and braking first feed roller 346. At block 708, first substrate 378 is fed along feed path 338 using second feed roller 347 after first substrate 378 is disengaged from first feed roller 346.

Referring to FIG. 5, substrate transport 343 also includes a third feed roller 384. Third feed roller 384 is configured to support first substrate 378 on second feed roller 347 during the step of feeding the first substrate along feed path 338 using second feed roller 347 as illustrated in block 708. After second feed roller 347 disengages from first substrate 378, first feed roller 346 can drive second substrate 380 out of substrate holder 304 in forward direction 381 along feed path 338 such that second substrate 380 can be fed along feed path 338 using second feed roller 347.

Following the step of feeding first substrate 378 along feed path 338 using second feed roller 347, a process is performed on first substrate 378. Such a process can include printing an image on a bottom surface 341 (FIG. 6) of first substrate 378, laminating an overlaminate to first substrate 378, encoding data to first substrate 378 and laminating first substrate 378 to a card substrate.

For example, FIG. 6 illustrates a transfer roller 348 positioned below processing path 338. Transfer roller 348 positions transfer ribbon 316 that includes an image adjacent feed path 338. During processing, transfer roller 348 transfers an image from transfer ribbon 316 to a bottom surface 341 of first substrate 378 as first substrate 378 moves along feed path 338. A first surface 327 of transfer ribbon 316 engages a top surface 353 of transfer roller 348, while second surface 328 of transfer ribbon 316 faces feed path 338. Transfer roller 348 presses transfer ribbon 316 and substrate 378 against a platen 349 such that a reverse-image printed on transfer ribbon 316 is transferred onto bottom surface 341 of first substrate 378. Transfer roller 348 uses heat and pressure to transfer the reverse-image printed on transfer ribbon 316 onto substrate 378.

In another example, a data writer 350 is also illustrated in FIG. 6. Data writer 150 is positioned between transfer roller 348 and substrate output 345 along feed path 338. While FIG. 6 illustrates data writer 350 positioned above feed path 338, it can also be positioned below feed path 338. Data writer 350 is configured to encode substrate 378 with data. In one embodiment, data writer 350 can write data to a magnetic stripe of substrate 378. In another embodiment, data writer 350 can write data to a memory of substrate 378. In yet another embodiment, a data reader can also be included that is configured to read data written to a magnetic stripe or memory of a substrate. After a process is performed on first substrate 378, first substrate 378 exits feed path 338 at output 345 and is retained by substrate hopper 306. Then, a similar process is performed on second substrate 380.

Figure 8:
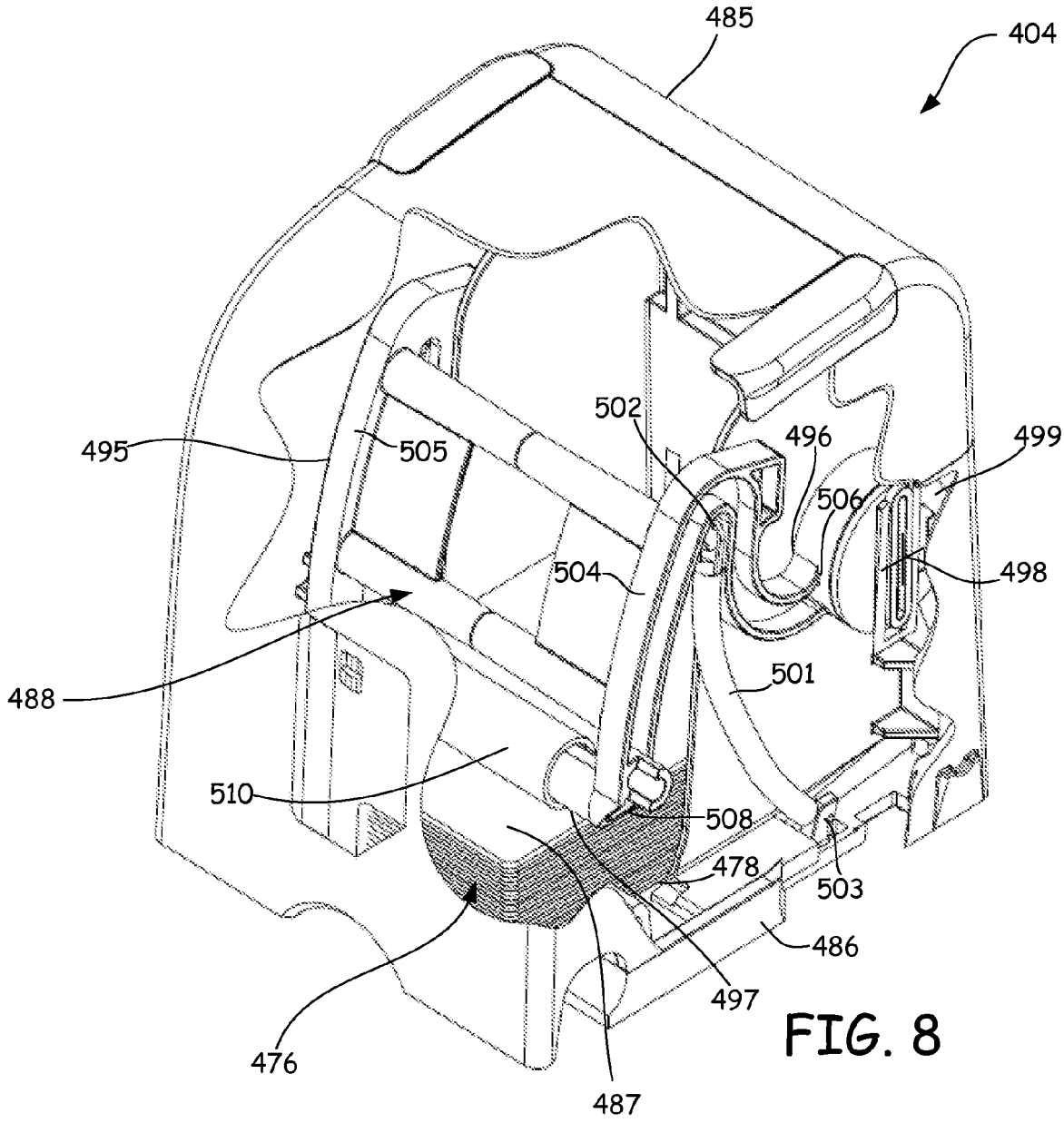
FIG. 8 illustrates a perspective view of a card holder under embodiments of the invention

In some embodiments, substrate holders 106, 206 and 306, previously discussed, can be a card holder for holding identification card substrates. FIG. 8 illustrates a perspective view of such a card holder 404 in accordance with embodiments of the invention. Card holder 404, illustrated in FIG. 8, is removed from a credential production device for illustrative purposes, but can is shown coupled to a credential production device in FIG. 1 and exploded from a credential production device in FIG. 2. Card holder 404 includes a housing 485 having a base 486. A stack of cards 476 are supported above base 486 and includes a top card 487 that is displaced a greater distance from base 486 than a bottom card 478 of stack of cards 476. Card holder 404 includes a card press 488. Card press 488 is configured to apply a load to top card 487.

Figure 9:
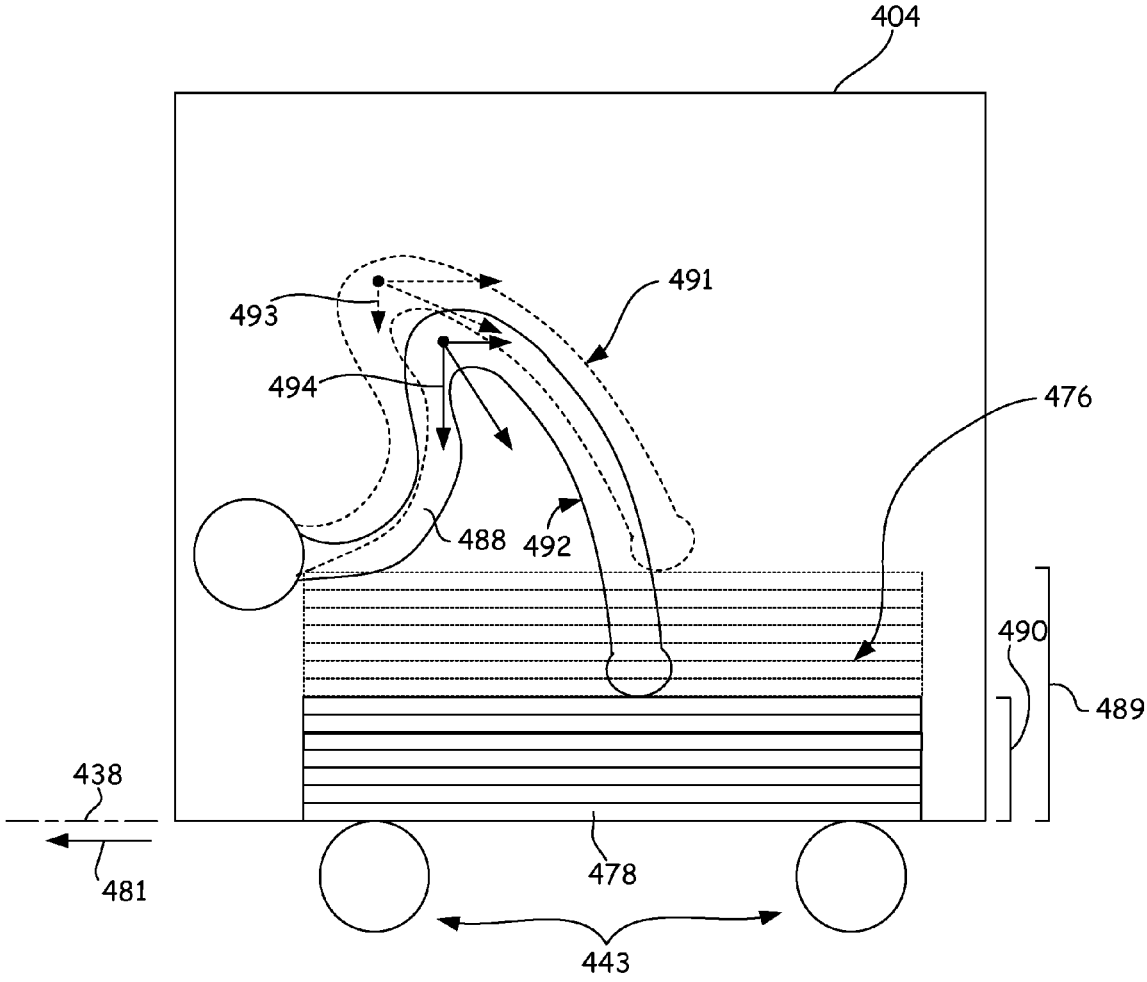
FIG. 9 illustrates a simplified schematic diagram of the card holder illustrated in FIG. 8.

FIG. 9 illustrates a schematic diagram of card holder 404 as it interacts with a card substrate transport 443 in accordance with embodiments of the invention. Card substrate transport 443 is configured to feed bottom card 478 from stack of card substrates 476 along a card feed path 438 in a forward direction 481. FIG. 9 illustrates a first amount 489 of card substrates and a second amount 490 of card substrates in card stack 476. First amount 489 of card substrates is greater than second amount 490 of card substrates. Therefore, first amount 489 of card substrates has a height that is greater than second amount 490 of card substrates, or rather, first amount 489 of card substrates has a thickness that is greater than a thickness of second amount 490 of card substrates.

FIG. 9 illustrates card press 488 at a first position 491 when card stack 476 has first amount 489 of card substrates. FIG. 9 also illustrates card press 488 at a second position 492 when card stack 476 has a second amount 490 of card substrates. At first position 491, card press 488 includes a perpendicular load component 493. At second position 492, card press 488 includes a perpendicular load component 494. As illustrated in FIG. 9, a magnitude of perpendicular load component 493 of first position 491 is less than a magnitude of perpendicular load component 494 of second position 492. Therefore, as the thickness of card stack 476 or the amount of card substrates in card stack 476 decreases, the magnitude of the perpendicular load component of card press 488 increases. In other words, a direction of a resultant load component (illustrated in FIG. 9) moves perpendicularly to base 486 as the thickness of stack of cards 476 decreases.

With reference back to FIG. 8 and in one embodiment, card press 488 includes an arm 495 coupled to a rotational mechanism 499. Arm 495 includes a first end 496 and a second end 497. First end 496 is configured to pivot about an axis 498. Rotational mechanism 499 provides axis 498. A portion of rotational mechanism 499 is configured to be fixed to housing 485 of card holder 404, while a remaining portion of rotational mechanism 499 is configured to rotate about axis 498. Rotational mechanism 499 will be discussed in more detail below. The perpendicular load component, such as perpendicular load component 493 or perpendicular load component 494, applied by card press 488 on card stack 476 is applied to top card 487 through second end 497 of arm 495. Second end 497 of arm 495 applies the perpendicular load component substantially uniformly across a width of top card 487.

In one embodiment, card press 488 can include a first arm component 504 and a second arm component 505. First arm component 504 includes a first end 506 that is configured to pivot about axis 498 and second arm component 505 includes a first end (hidden from view in FIG. 8) that is configured to pivot about axis 498. First arm component 504 includes a second end 508 and second arm component 505 includes a second end (hidden from view in FIG. 8).

In one embodiment, card press 488 includes a spring member 501. Spring member 501 includes a first end 502 and a second end 503. First end 502 of spring member 501 is coupled to arm 495 of card press. Second end 503 of spring member 501 is coupled to housing 485 of card holder 404. In particular, second end 503 of spring member 501 is coupled to base 486. Spring member 501 is configured to provide card press 488 with a load. The load applied by card press 488 is applied uniformly across width 500 of card stack 476. In particular, the load force supplied by spring member 501 is applied to top card 487 through second ends 508 and 509. Extending between second ends 508 and 509 of first arm component 504 and second arm component 505 and across width 500 of top card 487 includes a bar member 510. In this embodiment, the load force supplied by spring member 501 is applied through bar member 510.

Figure 10:
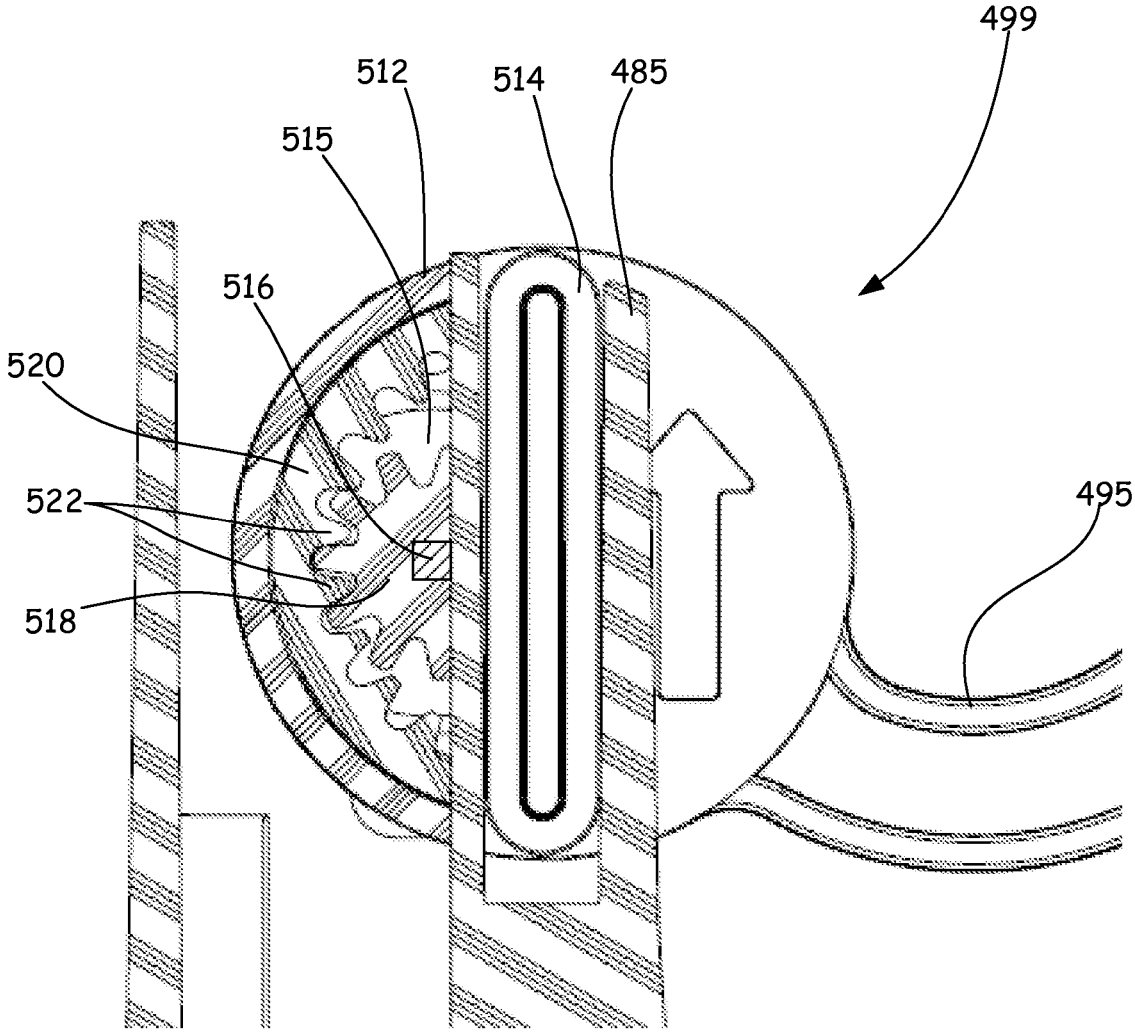
FIG. 10 illustrates a simplified sectional view of a rotational mechanism or dampener for the card holder of FIG. 8.

FIG. 10 illustrates an enlarged sectional view of rotational mechanism 499. Rotational mechanism 499 provides frictional resistance to movement of arm 495 (see also FIG. 8) and is coupled to a fixed guide 512 formed integrally with housing 485 of card holder 404. In one embodiment, rotational mechanism 499 includes a guide portion 514. Rotational mechanism 499 also includes a pinion gear 519 which is coupled to a rotary viscous damper 515 by a shaft 516. Rotary viscous damper 515 is fixed relative to arm 495. Rotational mechanism 499 also includes an outer ring gear 520 which is fixed about its rotational axis and only allowed to move in a vertical direction by fixed guide 512 of housing 485 and guide portion 514 of rotational mechanism 499. Fixed guide 512 and guide portion 514 allow outer ring gear 520 to in a vertical direction but not in a rotational direction. As arm 495 pivots, arm 495 forces pinion gear 518 to rotate as it interacts with the rotational fixed gear teeth 522 of outer ring gear 520. The interaction of pinion gear 518, outer ring gear 520 and viscous damper 515 provides a mechanism advantage which caused shaft 516 to spin at a faster rate than the rotation of arm 495. If the rotation of arm 495 is caused by gravity, the interaction of pinion gear 518, outer ring gear 520 and viscous damper 515 reduce the speed at which arm 495 lowers.

Figure 11:
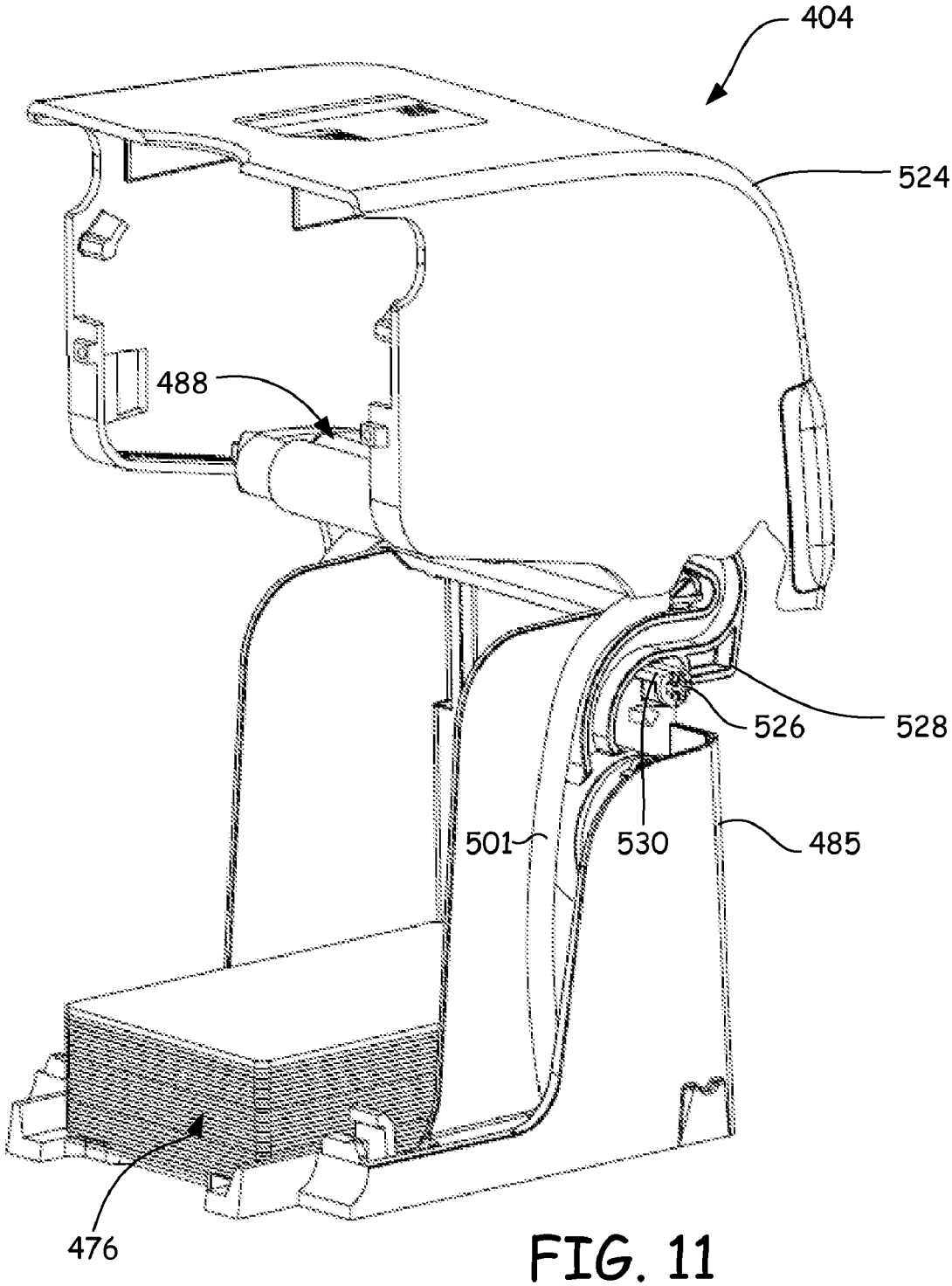
FIG. 11 illustrates a perspective view of the card holder illustrated in FIG. 8 with a cover in an open position.

FIG. 11 illustrates a perspective view of housing 485 of card holder 404. FIG. 11 illustrates that housing 485 includes a cover 524 that is rotatable about an axis 526. Cover 524 pivots about axis 526 between an open position (illustrated in FIG. 11) and a closed position (illustrated in FIG. 8). By rotating cover 524 about axis 526, stack of card substrates 476 can be easily loaded into card holder 404. To prevent spring member 501 from biasing cover 524 into a closed position by card press 488 with a load, card press 488 includes a latch 528 that is integrally formed with arm 488. Latch 528 is configured to be positioned around axis 526 that includes a bar 530 to hold card press 488 in place. Therefore, the load supplied by spring member 501 is removed from top card 487 when cover 524 is moved into an open position (as illustrated in FIG. 11) and the load supplied by spring member 501 is applied to top card 487 when cover 524 is in a closed position (as illustrated in FIG. 8).

Although the present invention has been described with reference to preferred embodiments, workers skilled in the art will recognize that changes may be made in form and detail without departing from the spirit and scope of the invention.

What is claimed is:

1. An identification card manufacturing device comprising:

a card holder comprising a housing including a base;

a stack of cards supported above the base including a top card that is displaced a greater distance from the base than a bottom card of the stack of cards;

a card press configured to apply a load to the top card, the load including a perpendicular load component oriented perpendicularly to the base and having a magnitude that increases as a thickness of the stack of card decreases;

a card transport configured to feed the bottom card from the stack of cards along a card feed path; and a card processing device in line with the card processing path and configured to perform a process on the card.

2. The device of claim 1, wherein the card press includes an arm having first and second ends, wherein the first end is configured to pivot about an axis and the load is applied to the top card through the second end of the arm.

3. The device of claim 2, wherein the card press includes a spring member coupled to the arm.

4. The device of claim 2, wherein the second end of the arm applies the perpendicular load components substantially uniformly across a width of the top card.

5. The device of claim 2, further comprising a rotational mechanism including gearing and a viscous damper coupled to the first end of the arm and produces frictional resistance to movement of the first end about the axis.

6. The device of claim 1, wherein the card press includes first and second arms each having a first end configured to pivot about an axis and a second end through which the load is applied to the top card.

7. The device of claim 6 including a bar member extending between the second ends of the first and second arms and across a width of the top card, wherein the load is applied to the top card through the bar member.

8. The device of claim 1, wherein the housing includes a cover configured to pivot between opened and closed positions.

9. The device of claim 8, wherein the load is removed from the top card when the cover is moved to the opened position and the load is applied to the top card when the cover is in the closed position.

10. The device of claim 1, wherein the direction of the load moves perpendicularly towards the base as the thickness of the stack of cards decreases.

11. The device of claim 1, wherein the card processing device is selected from the group consisting of a printing device, a laminating device an encoding device and a card flipping device.

12. A card holder for use with an identification card manufacturing device comprising:

a housing including a base; and a card press configured to apply a load to a top card of a stack of cards supported above the base, the load including a perpendicular load component oriented perpendicularly to the base and having a magnitude that increases as a thickness of the stack of cards decreases.

13. The card holder of claim 12, wherein the card press includes an arm having a first end pivotally connected to the housing and a second end through which the load is applied to the top card.

14. The card holder of claim 13, wherein the card press includes a spring member having a first end coupled to the arm and a second end coupled to the housing.

15. The card holder of claim 13, wherein the second end of the arm applies the perpendicular load component substantially uniformly across a width of the top card.

16. The card holder of claim 13, further comprising a rotational mechanism including gearing and a viscous damper coupled to the first end of the arm and produces frictional resistance to movement of the first end about the axis.

17. The card holder of claim 12, wherein the card press includes first and second arms each having a first end pivotally connected to the housing and a second end through which the load is applied to the top card.

18. The card holder of claim 17 including a bar member extending between the second ends of the first and second arms and across a width of the top card, wherein the load is applied to the top card through the bar member.

19. The card holder of claim 12, wherein:

the housing includes a cover configured to pivot between opened and closed positions; and the load is removed from the top card when the cover is moved to the opened position and the load is applied to the top card when the cover is in the closed position.

20. The card holder of claim 12, wherein a direction of the load moves more perpendicularly towards the base as the thickness of the stack of cards decreases.

* * * * *